United States Patent [19]

Tsai

[11] Patent Number: 4,987,998

[45] Date of Patent: Jan. 29, 1991

[54] RETENTION DEVICE FOR COLLECTING SOCKETS AND WRENCHES

[76] Inventor: Chiung C. Tsai, No. 331, Ren Shin Rd., Wu Lin Tsuen, Ren Wu Shiang, Kaohsiung Hsien, Taiwan

[21] Appl. No.: 526,980

[22] Filed: May 22, 1990

[51] Int. Cl.[5] ..... B65D 85/20; A47G 29/00

[52] U.S. Cl. ..... 206/372; 206/377; 206/378; 206/480; 206/464; 211/70.6

[58] Field of Search ..... 206/378, 377, 376, 375, 206/374, 373, 372, 483, 480, 477, 464, 465, 493; 211/70.6, 89; 248/316.7

[56] References Cited

U.S. PATENT DOCUMENTS

| | | | |
|---|---|---|---|
| 2,707,052 | 4/1955 | Brown | 211/89 X |
| 3,904,034 | 9/1975 | Saunders | 206/378 |
| 4,337,860 | 7/1982 | Carrigan | 206/378 X |
| 4,353,465 | 10/1982 | Rado | 206/378 |
| 4,826,021 | 5/1989 | Burrell | 211/70.6 |
| 4,927,020 | 5/1990 | Randy | 206/378 |
| 4,941,571 | 7/1990 | Barrett et al. | 206/378 |

*Primary Examiner*—Paul T. Sewell
*Assistant Examiner*—Jacob K. Ackun, Jr.
*Attorney, Agent, or Firm*—Steinberg & Raskin

[57] ABSTRACT

A retention device used for collecting or storing sockets and wrenches of different sizes for easy access and selection. The retention device is comprised of a frame plate having a number of spaced receiving strips. First clips having a curved head and a pair of wing portions that are removable and mounted on the receiving strip to receive sockets. Substantially C-shaped second clips are fixedly attached on the curved head of some of the first clips in order to receive wrenches.

2 Claims, 4 Drawing Sheets

RETENTION DEVICE FOR COLLECTING SOCKETS AND WRENCHES

BACKGROUND OF THE INVENTION

The present invention relates generally to retention devices for collecting sockets and wrenches. More particularly, the present invention relates to such retention devices which comprise a frame plate of unitary construction and removable means attached on the frame plate for receiving sockets and wrenches.

When it becomes necessary to pick a socket or wrench of a determined size, it is desirable to pick the right one as quick as possible to save time and to expedite the normal operation, e.g., adjusting or fastening screws. Heretofore, no satisfactory devices have ever been proposed to collect the frequently used sockets and wrenches.

It is the purpose of this present invention to facilitate the operation of choosing a desired socket or wrench from an aggregate of sockets and wrenches by proposing a retention device on which frequently used sockets and wrenches can be stored or collected for future selection.

SUMMARY OF THE INVENTION

Accordingly, it is the primary objective of this invention to provide a retention device for collecting sockets and wrenches comprising: a frame plate having a plurality of receiving strips in spaced parallel thereon; a plurality of first clips engageable with the receiving strips of the frame plate and adapted to receive a socket; and a plurality of second strips fixedly attached on a selected number of the first clips and adapted to receive a wrench.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
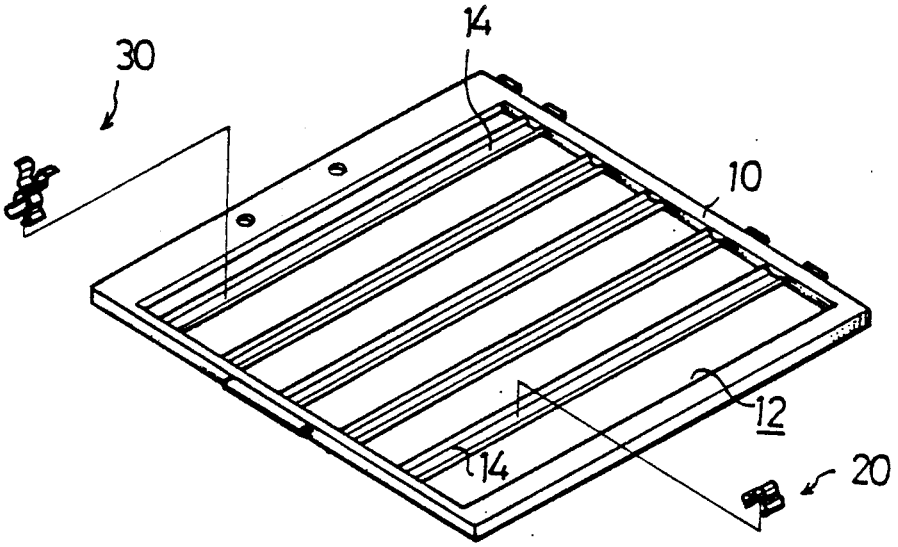
FIG. 1 is a perspective of the retention device of this invention with several first and second clips being schematically shown.

Referring now to the drawings, and more particularly to FIGS. 1, 2–2A and 3–3A, there is shown the retention device for collecting sockets and wrenches which incorporates the preferred embodiment of the present invention. The retention device comprises a frame plate 10, a plurality of first clips 20 releasably mounted on the frame plate 10, and a plurality of second clips 30 releasably mounted on the frame plate 10.

The frame plate 10 has a substantially rectangular opening 12 and a plurality of receiving strips 14 in spaced parallel on the frame plate 10 and over the opening 12, as can be seen from FIG. 1. In this embodiment, it is preferable that he frame 10, including the receiving strip 14 thereof, is made of one single piece, such as by a pressing or punching operation, from a metal sheet. The receiving strip 14 comprises a substantially U-shaped web 142 and a pair of integral wing portions 144 extending sideways from the web 142.

Figure 2:
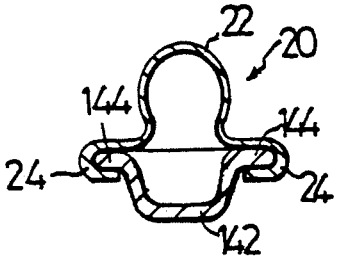
FIGS. 2 and 2A are cross-sectional views showing the first clip mounted on the receiving strip of the retention device of this invention and a socket being further mounted on the first clip, respectively.
Figure 2A:
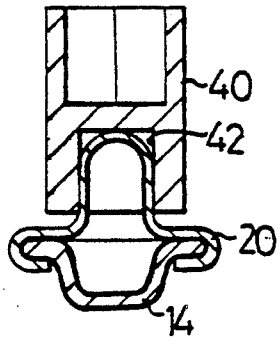

Each first clip 20 has a curved head 22 and a pair of curved wings 24 extending sideways from the curved head 22. The curved wings 24 engage with the wing portions 144 of the receiving strip 14 so that the first clip slides on the receiving strip 14. The curved head 22 possesses resiliency and is shaped and sized in such a manner that a socket 40 with an engaging hole 42 of smaller diameter than the width of the curved head 22 can be placed on the curved head 22 of the first clip 20 firmly, as shown in FIG. 2A. It is noted that first clips having different width may be required in order to receive different sockets of variable engaging-hole size.

Figure 3:
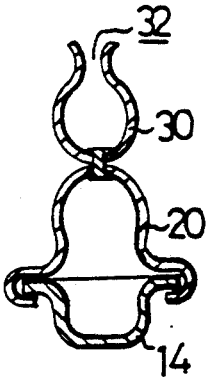
FIGS. 3 and 3A are cross-sectional views showing the second clip mounted on the first clips in accordance with this invention and a wrench being further received by the second clip, respectively.
Figure 3A:
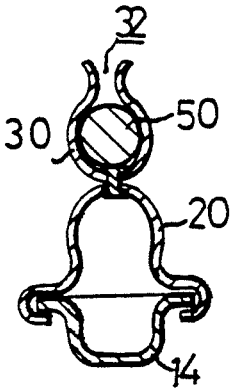

Each second clip 30 is substantially C-shaped to define an opening 32. As clearly shown in FIG. 3, the second clip 30 is fixedly attached on the curved head 22 of the first clip 20, for example by riveting, with its opening 32 facing upward and in a direction away from the first clip 20. The second clip 30 also possesses resiliency and is shaped and sized in such a manner that a wrench 50 with a suitable diameter can be received by the second clip 30 firmly, as shown in FIG. 3A. It is noted that second clips having different inner diameter may be required in order to receive different wrenches of variable diameter.

Figure 4:
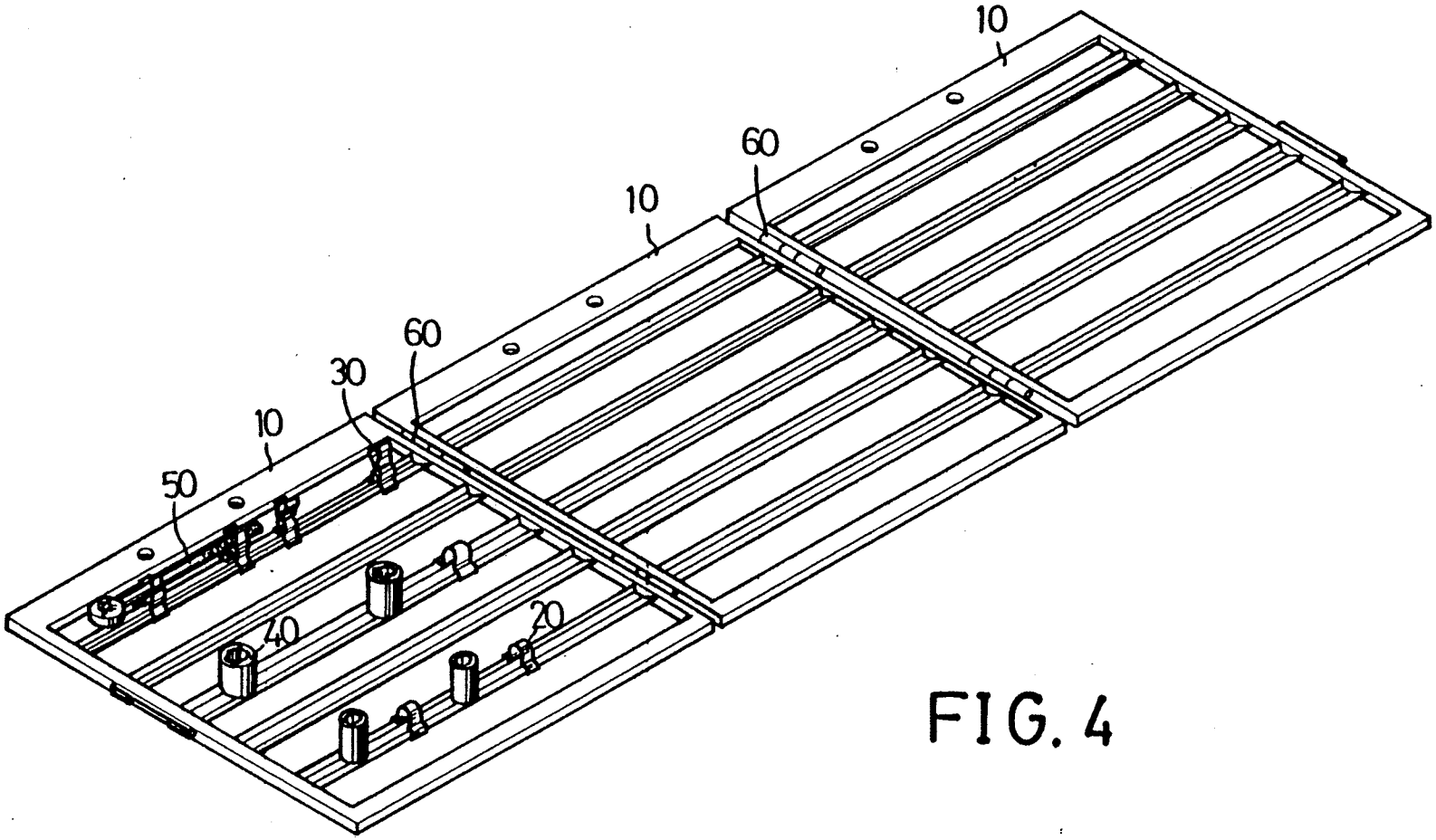
FIG. 4 is a perspective view showing three retention devices of FIG. 1, interconnected with hinges , with sockets and wrenches mounted thereon.

FIG. 4 shows three retention devices of this invention interconnected with hinges 60, with several sockets and wrenches of different sizes mounted on the first and second clips. The hinges used for connection of retention devices may be leaf and pin.

Figure 5:
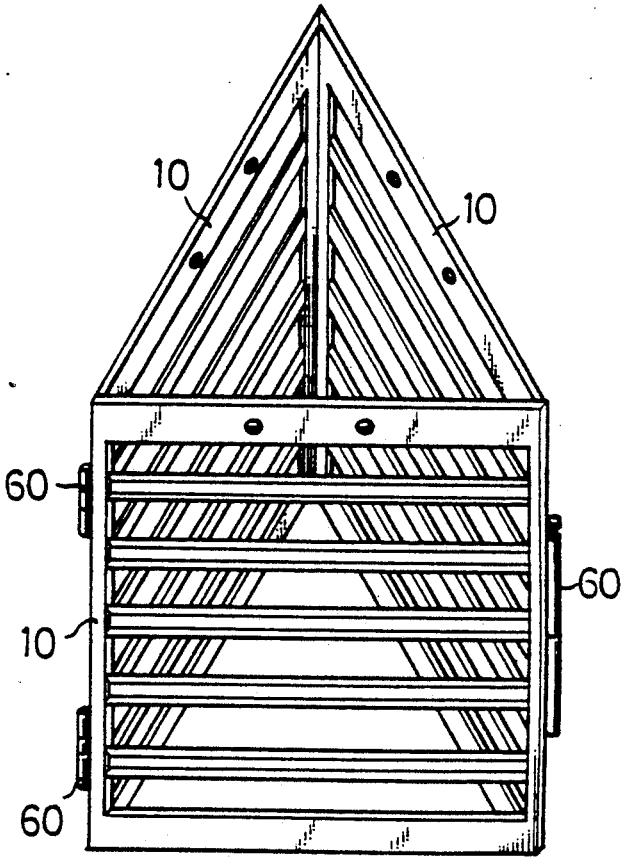
FIG. 5 is a perspective view showing the three retention devices of FIG. 4 interconnected to form a loop.

FIG. 5 shows the three retention devices of FIG. 4 being further interconnected to form a loop. This is advantageous since the retention device loop can then be tilted in such a manner that the first and second clip are outwardly positioned, thereby facilitating the easy access of sockets and wrenches.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications that will fall within the scope of the appended claims.

I claim:

1. A retention device for collecting sockets and wrenches comprising:

a frame plate having a substantially rectangular opening and a plurality of receiving strips spaced in parallel on said frame plate and over said opening, each receiving strip comprising of a substantially U-shaped web and a pair of integral wing portions extending sideways from said web;

a plurality of first clips having a curved head and a pair of curved wings extending sideways from said curved head, said curved wings engaged with said wing portions, said curved head possessing resiliency and being shaped and sized to be able to receive a socket; and a plurality of second clips being substantially C-shaped to define an opening, said second clips being fixedly attached on said curved head of a selected number of said first clips with the opening facing upward and in a direction away from said first clips, said second clips possessing resiliency and being shaped and sized to be able to receive a wrench.

2. A retention device as claimed in claim 1, wherein said frame plate is provided on at least one of its sides with hinges for interconnecting at least two retention devices side by side.

* * * * *